US005123864A

United States Patent [19]

Karlovich

[11] Patent Number: 5,123,864

[45] Date of Patent: Jun. 23, 1992

[54] COAXIAL CONTACT WITH SLEEVE

[75] Inventor: Robert J. Karlovich, Mechanicsburg, Pa.

[73] Assignee: AMP Incorporated, Harrisburg, Pa.

[21] Appl. No.: 681,229

[22] Filed: Apr. 5, 1991

[51] Int. Cl.[5] ..... H01R 17/04

[52] U.S. Cl. ..... 439/585; 439/877

[58] Field of Search ..... 439/578-585, 439/675, 877

[56] References Cited

U.S. PATENT DOCUMENTS

| | | | |
|---|---|---|---|
| 3,103,548 | 9/1963 | Concelman | 439/585 |
| 4,249,790 | 2/1981 | Ito et al. | 439/583 |
| 4,280,749 | 7/1981 | Hemmer | 439/578 |
| 4,421,377 | 12/1983 | Spinner | 439/583 |
| 4,688,878 | 8/1987 | Cohen et al. | 439/585 |
| 4,717,355 | 1/1988 | Mattis | 439/584 |
| 4,799,902 | 1/1989 | Laudig et al. | 439/585 |
| 4,902,246 | 2/1990 | Samchisen | 439/578 |
| 4,990,104 | 2/1991 | Schieferly | 439/578 |
| 4,990,105 | 2/1991 | Karlovich | 439/578 |

FOREIGN PATENT DOCUMENTS

| | | | |
|---|---|---|---|
| 3306436 | 8/1984 | Fed. Rep. of Germany | 439/585 |
| 1411067 | 10/1975 | United Kingdom | 439/585 |

*Primary Examiner*—David L. Pirlot
*Attorney, Agent, or Firm*—David L. Smith

[57] ABSTRACT

There is disclosed a coaxial contact for termination to a coaxial cable. The coaxial contact has an electrically conductive shell defining an open forward end (116). A center contact (56) for termination to a center conductor (208) of the cable is disposed concentrically within and isolated from shell (104) by a dielectric insert (26) and ferrule (28). A sleeve (300) is positioned over the cable jacket during assembly and after the center contact, dielectric insert and ferrule are positioned, the sleeve is employed to lay the braid strands over the ferrule. The sleeve may be left over the braid and crimped between the shell and braid.

14 Claims, 9 Drawing Sheets

COAXIAL CONTACT WITH SLEEVE

BACKGROUND OF THE INVENTION

This invention relates to disposing the braid of a coaxial cable over a ferrule and in particular to a method and apparatus for achieving a more uniform lay of the braid of a coaxial cable around the ferrule resulting in improved electrical and mechanical performance of the resulting coaxial contact.

There is disclosed in U.S. Pat. Nos. 4,990,104 and 4,990,105 a coaxial contact, as well as an electrical connector in which the coaxial contact may be secured, securable to a coaxial cable having a coaxial center conductor separated from an outer conductor or braid by an insulator, with an insulative jacket surrounding the braid. The coaxial contact has a center contact terminable to the center conductor of the coaxial cable. An insulative insert is positioned around the center conductor and a ferrule is positioned thereover. The braid of the coaxial cable is positioned surrounding a portion of the ferrule and a shell is crimped onto the portion of the ferrule over which the braid is positioned. This crimp mechanically secures the coaxial contact assembly together and provides electrical continuity between the braid and the ferrule.

The method of assembly and resulting coaxial contact described above has been found to have strands of the braid that are not uniformly distributed around that portion of the ferrule covered thereby. In addition, occasionally braid strands are severed by the crimping process or swaged so as to be weakened. This necessitates more attention be given to tooling set up or the crimping process and more care and hence more time by the contact assembler. Some weakened braid strands subsequently fail or shear during handling in subsequent assembly operations such as during insertion of a coaxial contact into an electrical connector, during handling or flexure of the resulting cable assembly or during later removal or insertion of the coaxial contact from or into the connector housing. Such failure of braid strands is undesirable as it diminishes the electrical performance of the coaxial contact.

It would be desirable to be able to more uniformly lay the braid strands over the ferrule in an efficient manner and effect the crimping of the shell thereover in a manner that improved mechanical and electrical characteristics of the resulting contact.

SUMMARY OF THE INVENTION

A coaxial contact for termination to a coaxial cable. The coaxial contact has an electrically conductive shell defining an open forward end. A center contact for termination to a center conductor of the cable is disposed concentrically within and isolated from shell by a dielectric insert and ferrule. A sleeve is positioned over the cable jacket during assembly and after the center contact, dielectric insert and ferrule are positioned, the sleeve is employed to lay the braid strands over the ferrule. The sleeve may be left over the braid and crimped between the shell and braid.

DESCRIPTION OF THE PREFERRED EMBODIMENT

Figure 1:
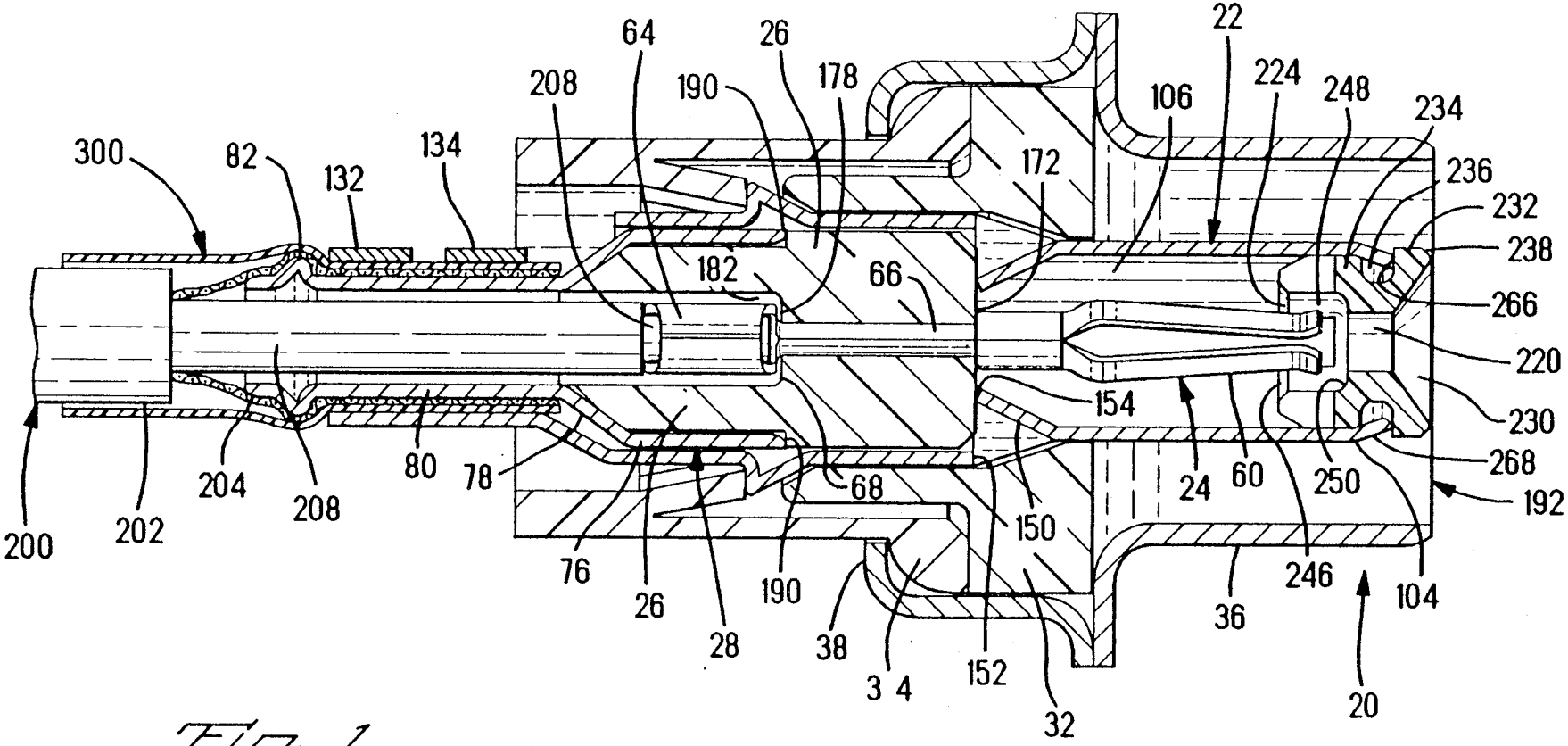
FIG. 1 is a partial cross section through a plug connector showing a coaxial contact having a nonconductive sleeve, in accordance with the present invention.

A connector 20 is shown in FIG. 1 including a plug coaxial contact 22 having a center contact 24 secured therein by a dielectric insert 26 partially surrounded by a ferrule 28 and with a shell 104 crimped onto the ferrule with strands of the braid therebetween and a nonconductive sleeve 300 between the braid and the crimped tines of the shell in accordance with the present invention. Connector 20 includes front and rear dielectric housing members 32,34 and, if shielded, includes front and rear shell means 36,38. Coaxial plug contact 22 may be used in conjunction with connector 20 or alone. When used in conjunction with connector 20, contact 22 may be secured in connector 20 in accordance with U.S. Pat. No. 4,990,104, the disclosure of which is hereby incorporated by reference, or any other known method.

Figure 3:
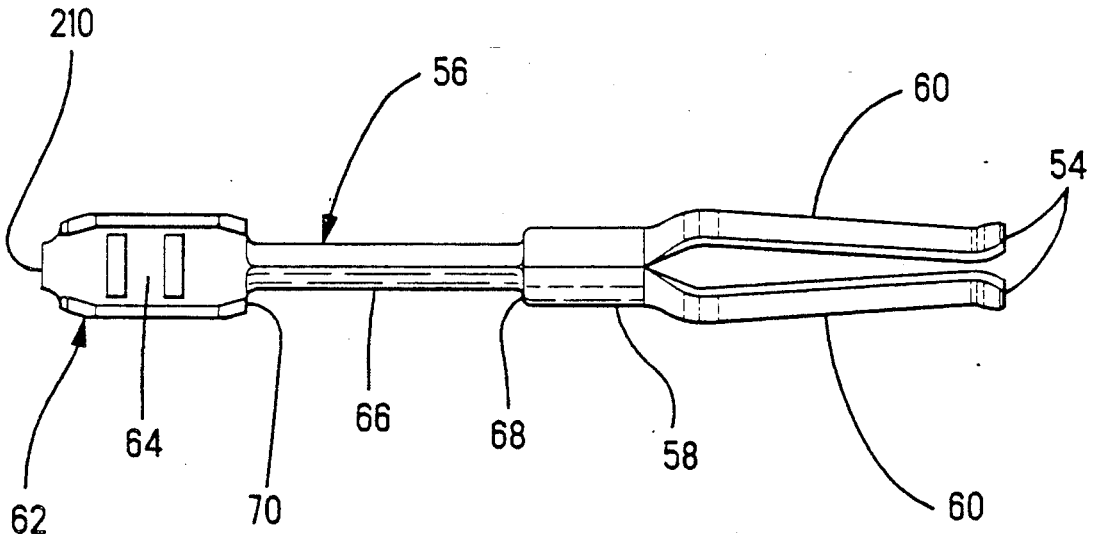
FIG. 3 is a receptacle center contact.

Center contact 24 shown in FIG. 1 is a receptacle contact 56. A top view of an unterminated receptacle contact 56 is shown in FIG. 3. Contact 56 is typically stamped and formed from an electrically conductive material, such as phosphor bronze stock, having a cylindrical barrel 58 formed with cantilever beams 60 extending therefrom for receiving therebetween mating portion of a pin contact. Contact 56 also includes a terminating portion 62 in the form of a crimped barrel 64, and a reduced diameter shank 66 between the cylindrical barrel and crimp barrel. The differential diameter between shank 66 and cylindrical barrel 58 defines a rearwardly facing annular shoulder 68. The difference in diameter between shank 66 and barrel 64, when crimped, defines forwardly facing shoulder 70. Thus, shank 66 extends between shoulders 68 and 70.

Figure 4:
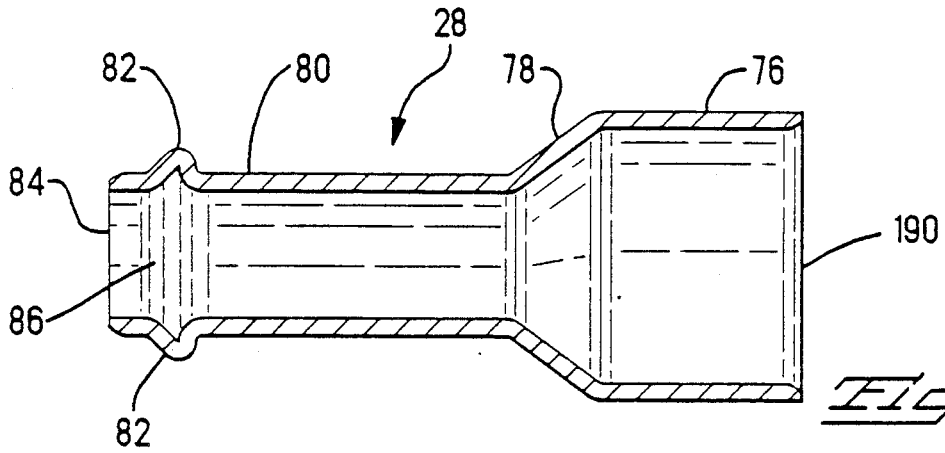
FIG. 4 is a ferrule for use with a coaxial contact.

A drawn conductive ferrule 28 is shown in FIG. 4 for a coaxial cable. While the ferrule in the preferred embodiment is a drawn member, such a ferrule could also be stamped and formed. Ferrule 28 is electrically conductive and typically manufactured from brass. Ferrule 28 has a large diameter forward end 76, a tapered section 78 and a cylindrical section 80. The cylindrical section has an annular ridge 82 of larger diameter than the respective cylindrical section proximate the free edge 84, with free edge 84 defining a cable entry 86.

Figure 5:
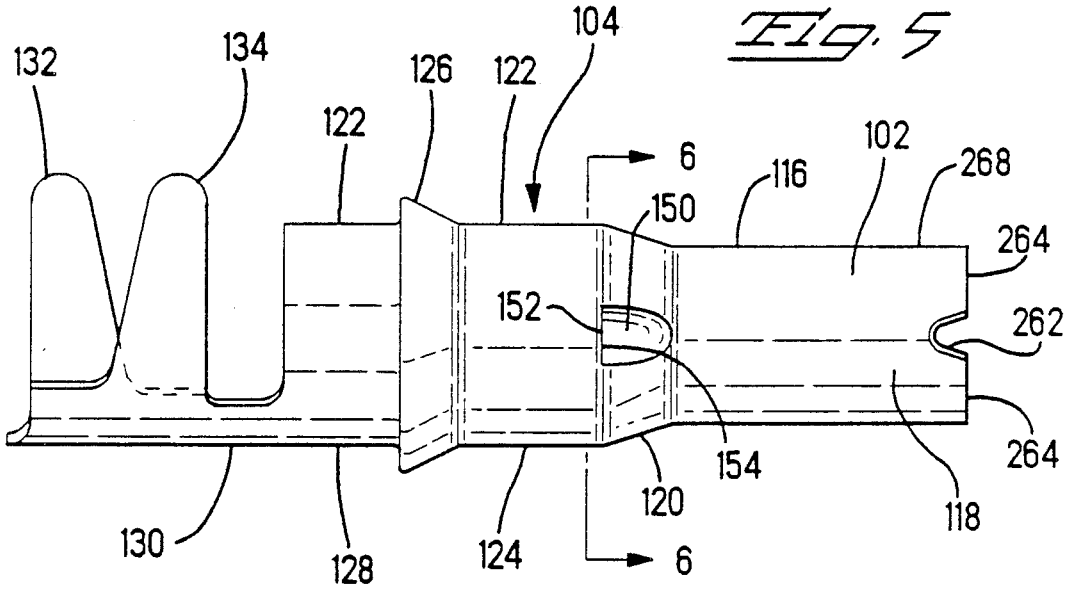
FIG. 5 is a side view of the plug shell.

A side view of plug shell 104 is shown in FIG. 5. Plug shell 104 has a hollow, generally cylindrical shape. Shell 104 is typically stamped and formed of brass. Shell 104 has a reduced diameter forward end 116 the outside surface 118 of which is typically gold plated. Forward end 116 is sized such that the outer diameter is receivable within the forward end of a receptacle coaxial contact. Forward end 116 extends rearward to a transition region 120 of conical shape that tapers to a larger diameter section 122 that may have a retention section 126 therein. Rear section 122 includes ferrule receiving section 128 and insert receiving section 124 which have substantially the same inside diameter in the preferred embodiment. Ferrule receiving section 128 has an inside diameter sized to receive the forward end 76 of ferrule 28 as best seen in FIG. 1. A portion of ferrule receiving section 128 extends rearward forming extension 130 with crimp tabs 132 and 134 extending upwardly therefrom.

Figure 6:
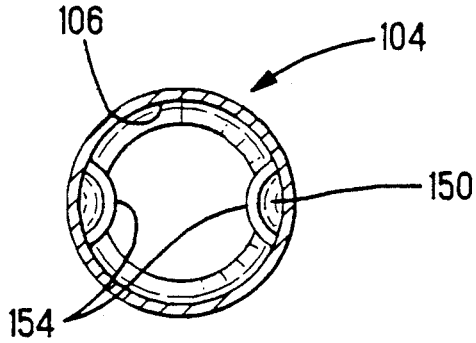
FIG. 6 is a cross-sectional view of the plug shell of FIG. 5 taken along lines 6—6 in FIG. 5.

Plug shell 104 has stops 150 formed from a shear line segment 152. Stop 150 is formed inwardly relative to shell 104 resulting in an arcuate stop shoulder 154, best seen in FIG. 6, which positions the leading surface 172 of insert 26 upon insertion into shell 104 and prevents over-insertion of insert 26.

Figure 2:
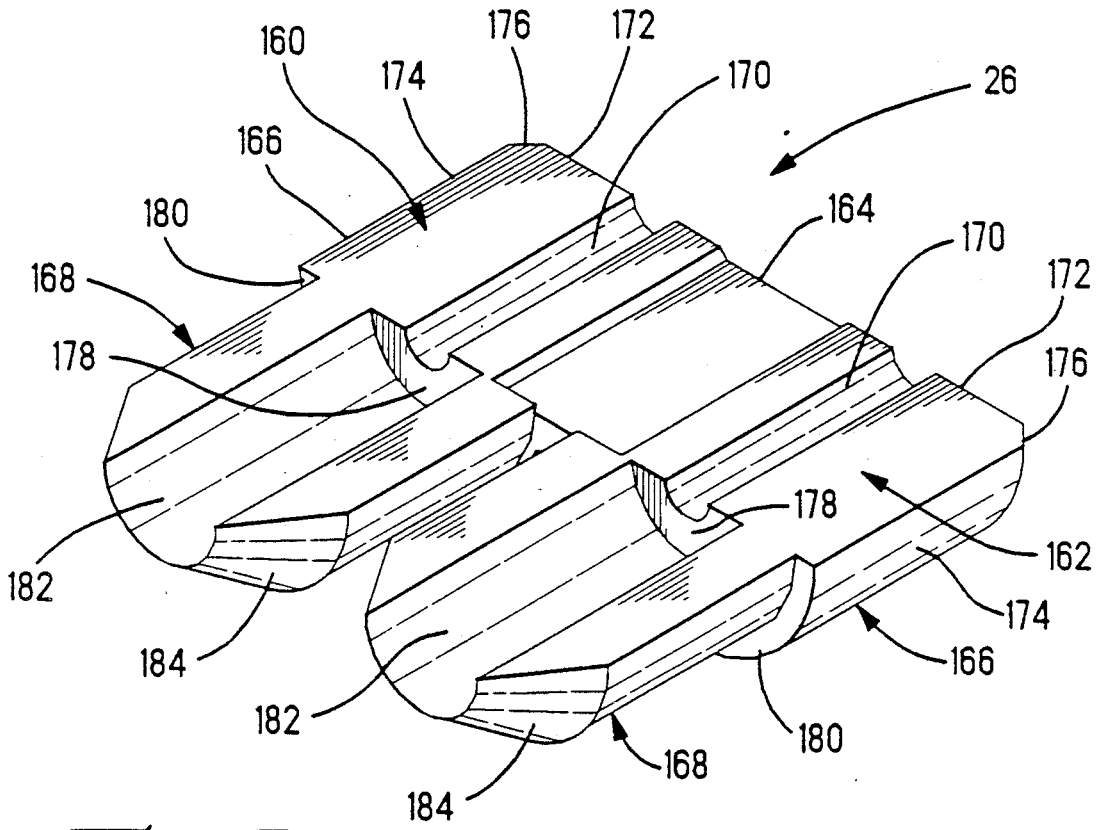
FIG. 2 shows a dielectric insert for a coaxial contact.

A two-piece dielectric insert is shown in FIG. 2. Two-piece dielectric insert 26 is comprised of two substantially identical halves 160,162. Halves 160,162 in the preferred embodiment are molded of polyolefin and are hingedly interconnected by web 164. Each half has a forward portion 166 and a rearward portion 168. Each forward portion is substantially semi-cylindrical having a semi-cylindrical channel 170 coaxially disposed therein. Forward surface 172 is semi-annular in shape and engages a stop shoulder 154 upon insertion of insert 26 into shell 104. The edge of surface 172 along semi-cylindrical side wall 174 may be beveled 176 to facilitate entry of insert 26 into a shell. The rear of forward portion 166 is defined by inner semi-annular surface 178 concentrically disposed about channel 170 and outer semi-annular surface 180 also concentrically disposed about channel 170.

The spacing or distance between surfaces 172 and 178 is substantially the same spacing or distance between shoulders 68 and 70 of receptacle contact 56 (see FIG. 3). The radius of semi-cylindrical channel 170 is substantially the same as or slightly smaller than the radius of shank 66 of a receptacle contact 56. When halves 160 and 162 are positioned over each other in the absence of web 164 or when the two halves are folded about web 164, the two forward portions 166 form a cylindrical structure with the two semi-cylindrical channels 170 forming a centrally located cylindrical bore therethrough.

Rearward portion 168 extends from and is integral with forward portion 160 of each half 160,162 between inner semi-annular surface 178 and outer semi-annular surface 180. Rearward portion 160 is substantially semi-cylindrical having a semi-cylindrical channel 182 coaxially disposed therein and extending from semiannular surface 178 rearward. The radius of channel 182 is typically larger than the radius of channel 170 as channel 170 accommodates the shank of a center contact 24 while channel 182 accommodates the crimped barrel of a center contact 24. When halves 160 and 162 are folded about web 164 or positioned over each other in the absence of web 164, rearward portions 168 form a cylindrical structure with two semi-cylindrical channels 182 forming a centrally located cylindrical bore therethrough. Rearward portion 168 may be beveled 184 at the trailing edge to be received in a tapered portion of a ferrule 28.

The outside diameter of the rearward portion, when halves 160,162 are folded about web 164, is sized to be closely received within the forward end 76 of ferrule 28, shown in FIG. 4, with the leading edge 188 of ferrule 28 abutting semi-annular surfaces 180 in the assembled contact to position and secure insert 26 in the desired location within shell 104. Thus, arcuate stop shoulders 154 provide a forward stop for insert 26 while surfaces 190 provide a rear stop for the insert. Insert 26 may be in accordance with U.S. patent application Ser. No. 07/531,192 filed May 31, 1990, entitled "Foldable Dielectric Insert For A Coaxial Contact" the disclosure of which is hereby incorporated by reference, or any other known insert.

Plug contact 22 comprises a center contact 24, in the form of receptacle contact 56, a dielectric insert 26, a shell 104, a ferrule 28, an insulated tapered lead-in insert 192 and a nonconductive sleeve 300. Other than insert 192, in the preferred embodiment, air is the only dielectric separating center contact 24 from or 104 forward of surface 172 of insert 26 where the function of insert 26 is to position and electrically isolate contact 24 coaxially within shell 104.

Figure 7:
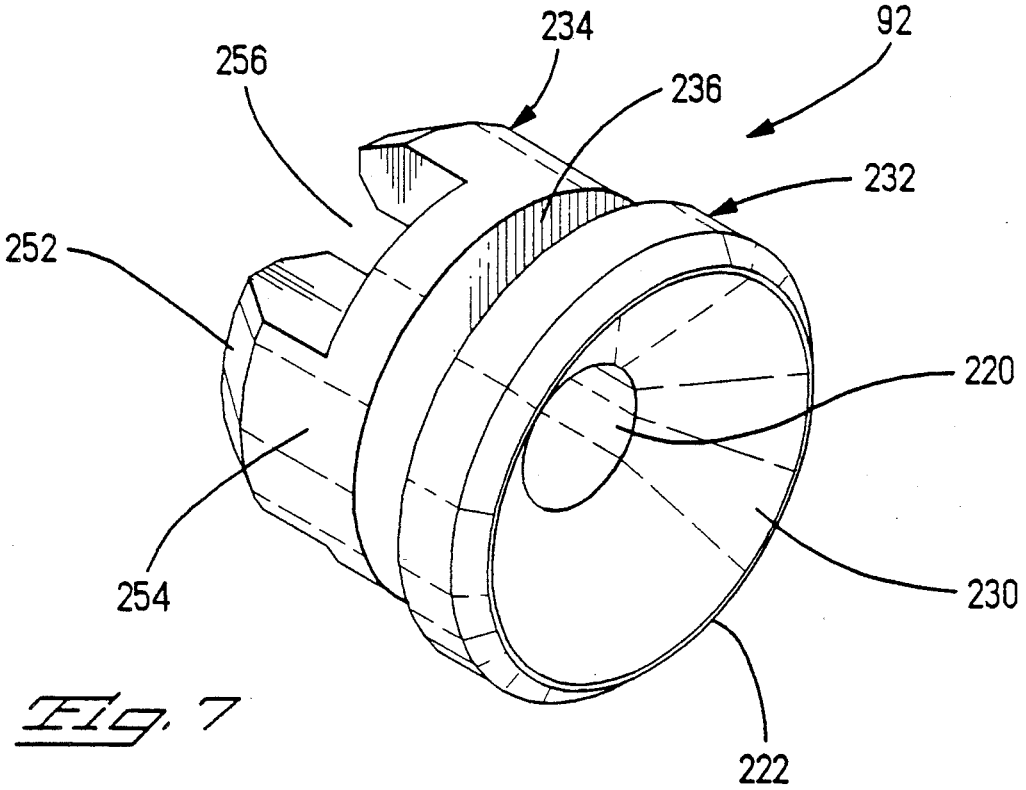
FIG. 7 is a front perspective view of the tapered lead-in insert.
Figure 8:
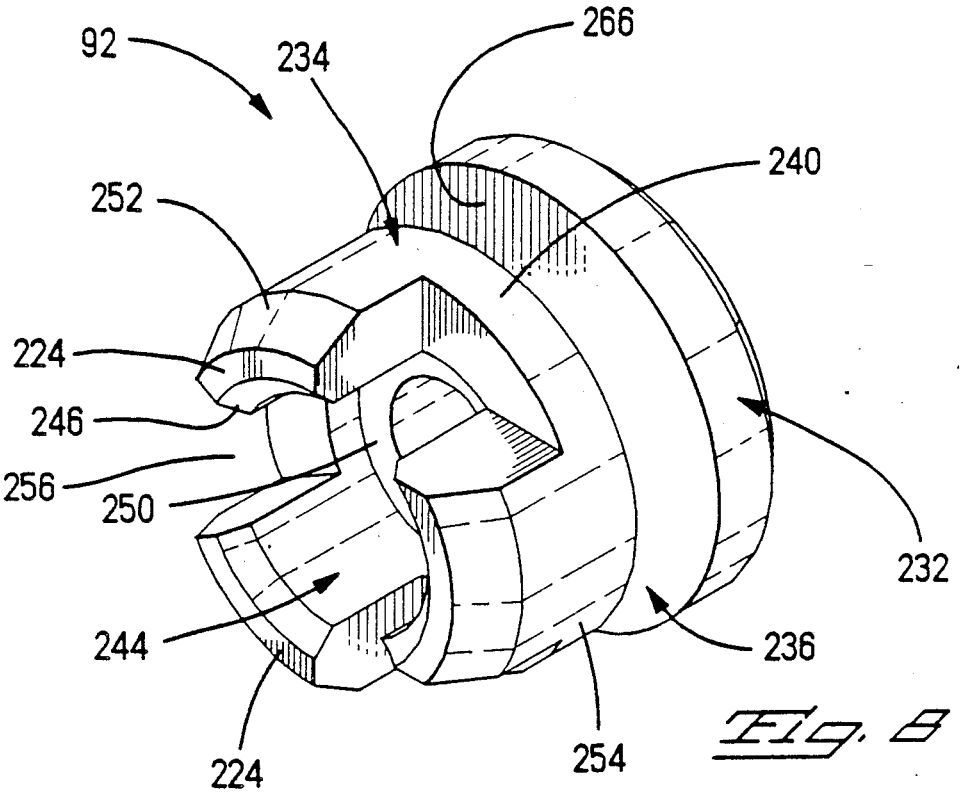
FIG. 8 is a rear perspective view of the tapered lead-in insert.

Tapered lead-in insert 192 is a dielectric insert as best seen in cross-section in FIG. 1, a front perspective view in FIG. 7 and a rear perspective view in FIG. 8. In the preferred embodiment, insert 192 is molded as a single member of a material having a low dielectric constant, such as polyolefin. Insert 192 provides a second dielectric member in contact 22 and is substantially cylindrical in shape having a central bore 220 extending from front surface 222 through insert 192 to rear surface 224. Bore 220 is sized to receive the center pin contact 226 of a mating contact 228 (see FIG. 19).

Tapering inwardly from front surface 222 to bore 220 is tapered lead-in 230, which in the preferred embodiment is conical in shape. Insert 192 includes a forward portion 232 and a rear portion 234 separated by annular recess 236. Forward portion 232 may be beveled 238 at the perimeter of front surface 222 to assist in alignment with contact 228 during mating.

The outside diameter of forward portion 232 in the preferred embodiment is slightly larger than the outside diameter of rear portion 234. The outside diameter of rear portion 234 is sized to be received within forward end 116 of contact 22. The outside diameter of forward portion 232 is sized to be substantially the same as or slightly smaller than the outside diameter of forward end 116 to facilitate being received within the shell of contact 228 during mating.

Rear portion 234 includes an annular section 240 adjacent annular recess 236 and a castellated flange portion 242 extending rearwardly therefrom. Enlarged bore 244 coaxial with bore 220 extends into at least a portion of flange portion 242. Bore 244 is beveled 246 around the periphery at rear surface 224 to facilitate insertion of the ends of cantilever beams 60. Bore 244 extends to a depth to accommodate the distal ends of cantilever beams 60 of center contact 56 and allows a gap 248 (FIG. 1) between the distal ends 54 and annular surface 250 which defines the differential radii between bores 220 and 244. Rear portion 234 is beveled 252 around the intersection of outer cylindrical surface 254 and rear surface 224 to facilitate insert 192 coaxially aligning with the inner surface 106 of forward end 116 of shell 104 during insertion thereinto.

Castellated flange 242 has interruptions or air gaps 256 spaced therearound with the air gaps extending from bore 244 through rear portion 234 to outer cylindrical surface 254. Thus, air surrounds the center contact as the insulator between the center contact, specifically cylindrical barrel 58 and beams 60, and the inner surface 106 of shell 104 from surface 172 of insert 26 to rear surface 224 of insert 192. Furthermore, air gaps 256 permit air to be the insulator through the region of the air gaps between that portion of the cantilever beams received within flange portion 242 and the inner surface 106 of shell 104. In the absence of another dielectric material through the region of the air gaps, air allows the impedance of contact 22 to be maximum.

Projections 258 defined in flange 242 by air gaps 256 are positioned between cantilever beams 60 and inner surface 106. In the preferred embodiment there are three projections 258. Bore 244 defines the inner surface 260 of each projection. Distal ends 54 of beams 60 are received within insert 192 and more specifically, bore 244 as best seen in FIG. 1. Projections 258 extend over only a limited portion of beams 60 with air separating the center contact from inner surface 106 of shell 104 rearward from surface 224 to surface 172 of insert 26. Beams 60 are spaced from surfaces 260 when there is not a pin contact 226 received between beams 60 and also under normal conditions when there is a pin received between beams 60. Projections 258, specifically inner surfaces 260 thereof, define radially outward stops that provide an anti-overstress function to limit deflection of beams 60 should a pin contact not axially aligned with center contact 24 be received between beams 60. The castellated flange provides the advantage of having insert 192 provide a lead-in for a pin contact of a mating coax contact, thereby providing an alignment capability yet simultaneously having an anti-overstress feature and some air surrounding the distal ends of the cantilever beams to maximize the impedance of contact 22. In this manner, coaxial contact 22 is designed to perform at a predetermined performance level in a 75 ohm application.

Insert 192 is typically secured to shell 104 prior to shell 104 being positioned over subassembly 212. A plurality of notches 262 are disposed in the periphery of leading edge 264 of shell 104. Insert 192 is axially aligned with forward end 116 of shell 104. Shell 104 and insert 192 are moved axially toward each other such that rear portion 234 is received within forward end 116. Due to forward portion 232 being slightly larger in diameter than rear portion 234, when insert 192 is received in forward end 116 a predetermined depth, leading edge 264 engages a sidewall 266 of annular recess 236. The forward end 268 of end 116 is crimped into annular recess 236, facilitated by notches 262, to be of a smaller diameter than rear portion 234 thereby securing insert 192 to shell 104 as best seen in FIG. 1.

Coaxial contact 22 may be assembled and terminated to a coaxial cable manually or using automated assembly equipment. The assembly procedure will be described with reference to the sequence of FIGS. 9–17.

Figure 9:
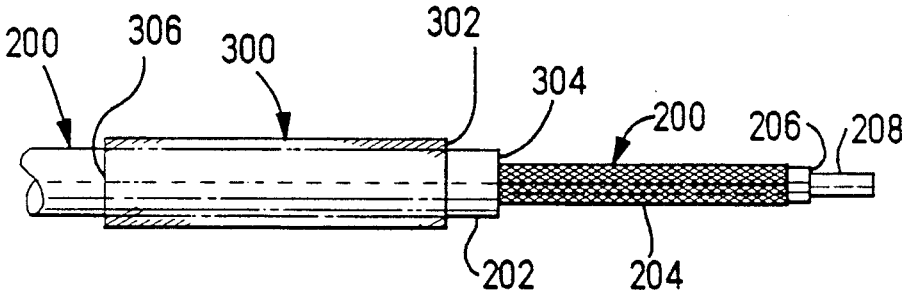
FIG. 9 is a coaxial cable with a prepared end, with a sleeve passed thereover and slid back over the jacket.

FIG. 9 shows a coaxial cable 200 for terminating to a coaxial contact 22 as described herein. The jacket 202, braid 204 and dielectric 206 of the cable have been removed to expose a length of approximately 6.75 mm of the center conductor 208. Further, jacket 202 has been removed to expose a length of approximately 25 mm of the braid.

A sleeve 300 has been passed over the prepared end of cable 200, back as far as jacket 202. In the preferred embodiment, sleeve 300 is a nonconductive material such as polyvinyl chloride having a cylindrical shape, although the invention is not limited thereto. The inside diameter of sleeve 300 is slightly greater than the outside diameter of jacket 202 so as to be readily passed thereover. Sleeve 300 may be position on the prepared end of cable 200 any time before ferrule is disposed thereon, or may be positioned on the cable from its other end.

Figure 10:
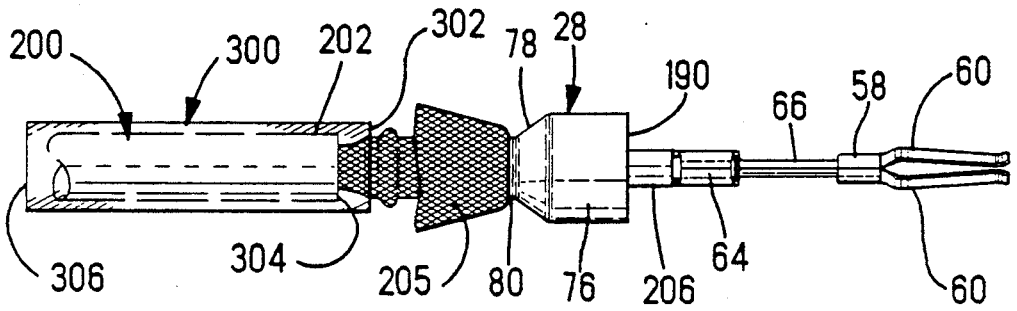
FIG. 10 shows a center contact crimped onto the center conductor of a coaxial cable, the braid folded back over itself and a ferrule disposed axially over the center conductor, partially beneath the folded over braid.

The stripped center conductor 208 is laid into the open crimp barrel 64 of a center contact 24. Preferably, the cable dielectric 206 is butted against the rear end 210 of the crimp barrel. The center conductor is crimped in the crimp barrel thereby securing the center conductor to the coax center contact to complete a mechanical and electrical connection therebetween. A center contact crimped onto the center conductor is shown in FIG. 10.

The coax cable braid 204 is splayed and the terminated center contact 24 is passed into cable entry 86 and through a ferrule 28. Alternatively, it may be stated that the ferrule is passed over the center contact or that the ferrule may be positioned on the prepared end of cable 200 before the center contact is crimped onto the center conductor. The ferrule is slid axially along the cable, with cylindrical section 80 between the cable dielectric 206 and the braid 204 to a position with the leading edge 190 beyond the crimp barrel of the center contact as shown in FIG. 10.

Figure 11:
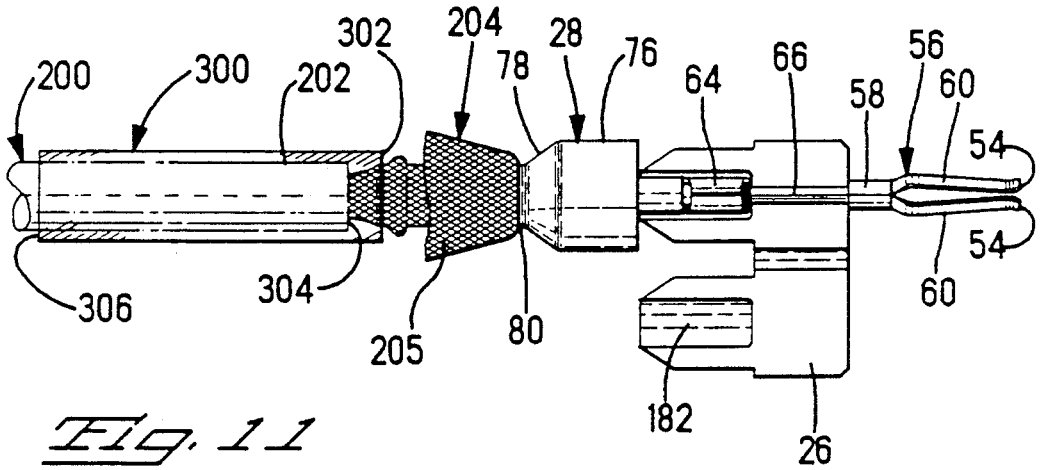
FIG. 11 shows a plastic insert positioned proximate the center contact.
Figure 12:
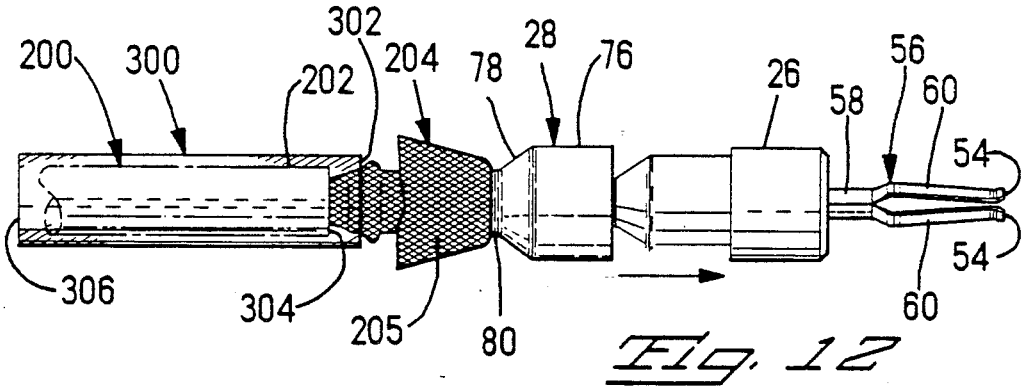
FIG. 12 shows the plastic insert folded over the center contact.
Figure 13:
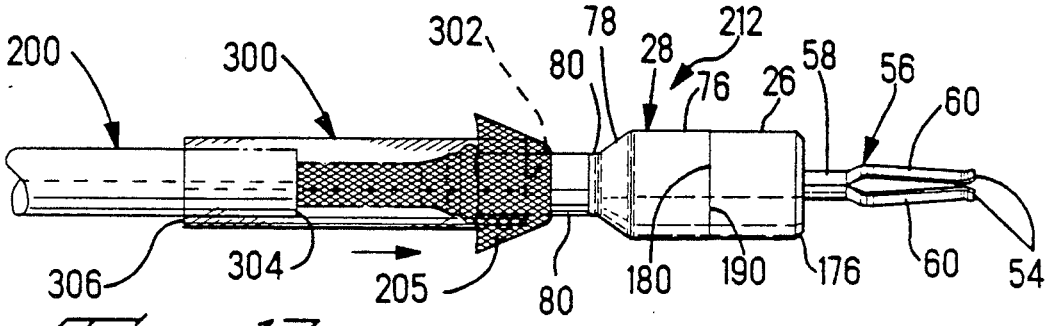
FIG. 13 shows the ferrule moved toward the distal end of the center contact disposed over the folded plastic insert.

As shown in FIG. 11, the center contact 24 is positioned in channels 170,182 of one half 160 or 162. The other half 162 or 160 is positioned over the center contact, or if web 164 is present the other half is folded at web 164 around the center contact as shown in FIG. 12.

The forward end of the insert is held to maintain the center contact in position while the ferrule is slid axially along the cable toward the end of the mating contact such that rearward portions of the insert are received within forward end 76 of the ferrule such as until leading edge 190 engages outer semi-annular surfaces 180. In this position shown in FIG. 13, insert 26 is prevented from being removed inadvertently. Insert 26 will not slide axially toward the unterminated end of center contact 24 due to the forward surfaces 172 engaging shoulders 52 or 68. In order to be removed, the two halves of the insert must be separated from each other to allow channels 170 to pass over shoulders 52 or 68. Thus, with insert 26 partially within ferrule 28, the center contact is held centered in insert 26 which in turn is centered within the ferrule.

Figure 14:
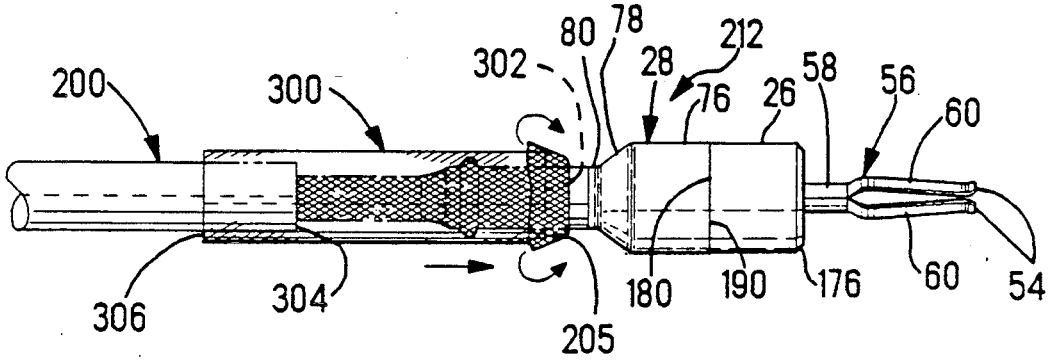
FIG. 14 shows the sleeve being moved axially along the cable with the braid strands rolling over the leading edge to be laid on the external surface of the ferrule.

Sleeve 300 is then moved toward the distal ends of center contact 56 to overlay the braid strands over the exterior surface of cylindrical section 80 of the ferrule. As shown in FIG. 14, as sleeve 300 is moved the leading edge 302 passes between the braid as it egresses proximate the end 304 of jacket 202 and the folded back portion 205 of braid 204. As sleeve 300 is moved, to the right in FIG. 14, the strands of braid 204 pass over the leading edge 302 from outside sleeve 300 to be within sleeve 300 thereby being laid substantially against the exterior surface of cylindrical section 80.

By using sleeve 300, the braid strands are returned to their interlaced structure and positioned around cylindrical section 80 substantially consistently and uniformly as compared to prior art methods of laying the strands of braid over cylindrical section 80. This can be viewed through a transparent sleeve, which is preferred.

Figure 15:
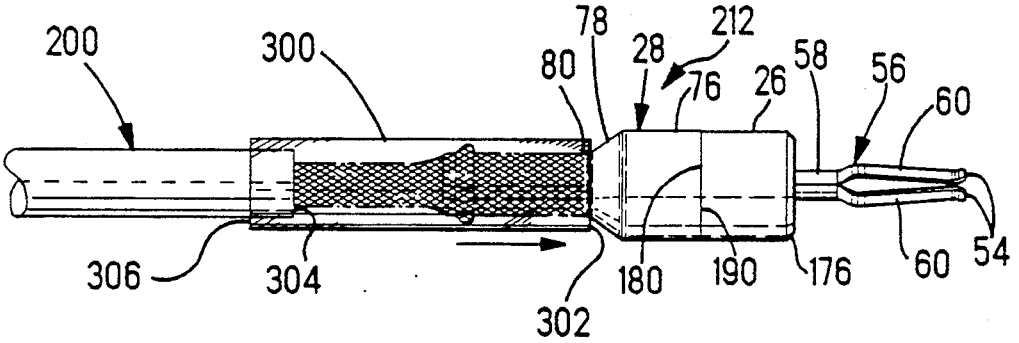
FIG. 15 shows the braid completely laid over the ferrule with the sleeve in final position.

Sleeve 300 is slid until the braid 204 is completely laid over cylindrical section 80 in the preparation for crimping shell 104. As shown in FIG. 15, the braid when laid over cylindrical section 80 extends substantially to tapered section 78. With the leading edge 302 of sleeve 300 proximate tapered section 78, trailing edge 306, in a preferred embodiment, overlaps the end of jacket 304. In this manner, when sleeve 300 in nonconductive, braid 204 is surrounded by an insulator which presents shorting of components to an otherwise exposed braid.

Figure 16:
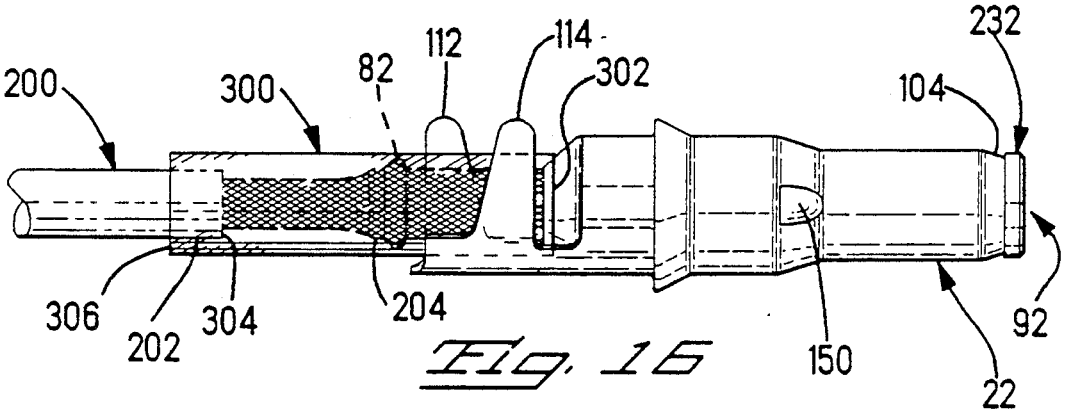
FIG. 16 shows a shell positioned over the subassembly of FIG. 15, positioned for crimping.

The above subassembly is then inserted into the ferrule receiving end of a shell 104 until forward surface 172 engages forward stops 150. This properly positions center contact 56, insert 26, ferrule 28 and subassembly 212 within shell 104 as shown in FIG. 16. When the coaxial contact being assembled is a plug contact, an insert 92 may be previously secured in shell 104 proximate the mating end.

As seen in FIG. 16, in this position cylindrical section 80 having braid 204 laid thereover and surrounded by sleeve 300 is received in ferrule receiving section 128 between tines 112 and 114 positioned for crimping.

Figure 17:
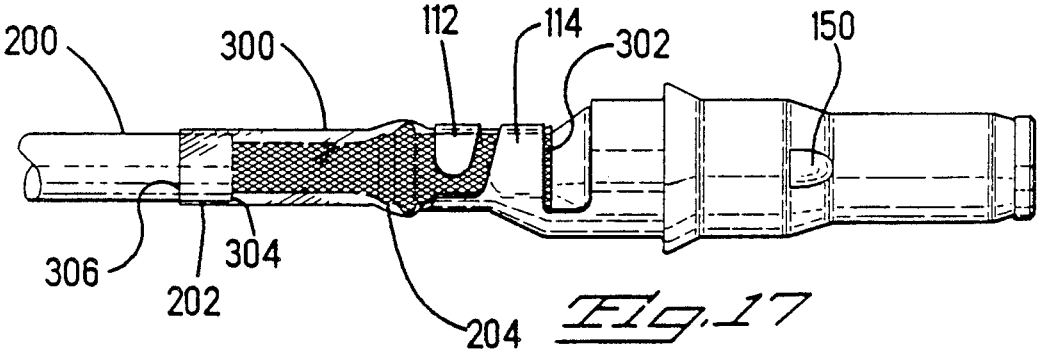
FIG. 17 shows the shell crimped, completing the subassembly.

FIG. 17 shows a coaxial contact with tines 112 and 114 crimped to complete the subassembly, securing shell 104 thereto and assuring electrical and mechanical engagement between braid 204 and the ferrule. The shell is electrically commoned to the braid through engagement with the ferrule. Since sleeve 300 is within the crimp, the crimp height is adjusted to accommodate its presence.

It has been found that the use of sleeve 300 more uniformly lays the braid over cylindrical section 80. Furthermore, greater consistency of the lay is achieved from one coaxial contact to another. Sleeve 300 maintains the braid strands in position between steps in the assembly process and reduces the time required to assemble a high integrity coaxial contact. Sleeve 300 may be left in the assembly, as described above in the preferred embodiment, or be removed after laying the braid over cylindrical section 80.

With sleeve 300 left in the assembly and crimped therein, it has been found that there is greater assurance that all of the strands are crimped between ferrule receiving section 128 of the shell and cylindrical section 80, resulting in a coaxial contact with improved electrical and mechanical properties. The presence of sleeve 300 substantially eliminates the severing of braid strands, thereby providing a greater cross-sectional area for current flow or damaging of braid strands during the crimping process.

As shown in FIG. 17, tabs 132,134 are then crimped over the braid to secure the shell to the subassembly and to complete an electrical path between braid 204 and ferrule 28. Crimping the tabs completes the assembly of the coax contact with the crimped tabs securing all parts of the connector together. This provides a strain relief through the braid to the outer shell rather than through the center contact. The crimped tabs are between the annular ridge 82 and forward end 76 with the larger diameter of annular ridge 82 preventing the crimped tabs from otherwise sliding off cylindrical section 80. The completed coaxial contact 22 may be inserted into dielectric housing means 34,36 if desired.

Figure 18:
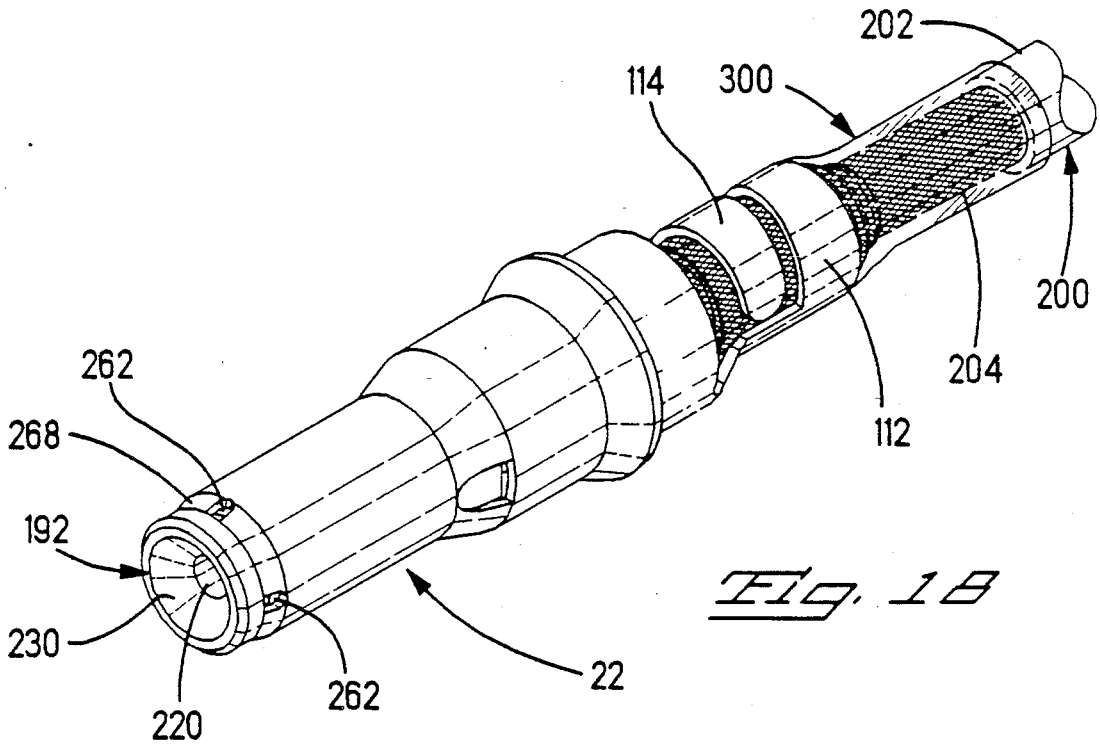
FIG. 18 shows a coax contact in accordance with the present invention terminated to a coaxial cable.
Figure 19:
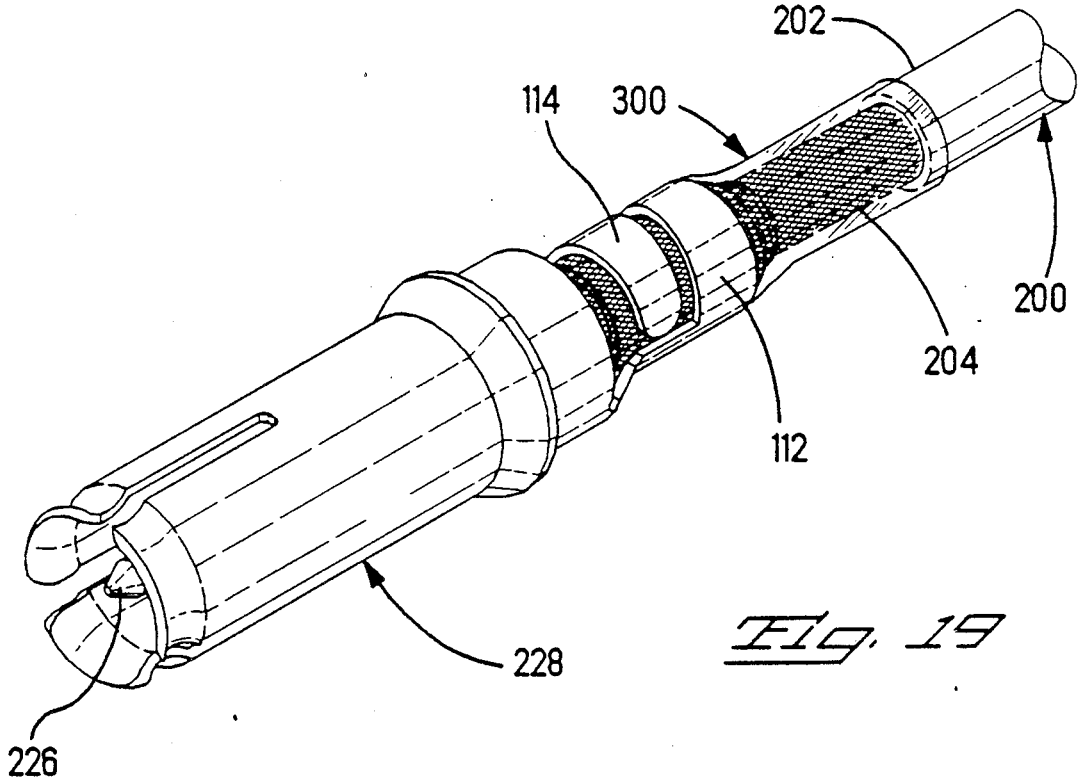
FIG. 19 shows a complementary coax contact for mating with the coax contact of the present invention.
Figure 20:
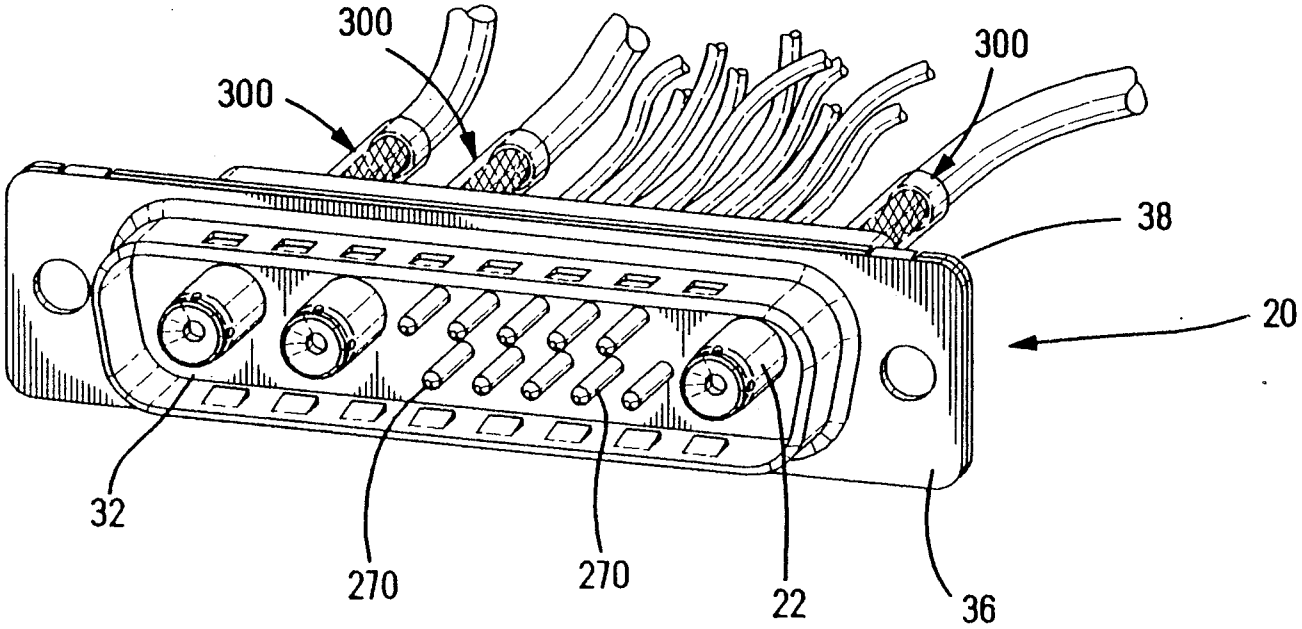
FIG. 20 shows a front perspective view of a coax mix connector including the coax contact of the present invention.

FIG. 18 shows a front perspective view of a coax terminal 22. FIG. 19 shows a perspective view of a mating contact 228. FIG. 20 shows a front perspective view of a coax mix connector including contact 22 and a plurality of non-coax contacts 270 secured in the connector housing.

While the preferred embodiment has been described employing a crimp termination of the center conductor to the center contact and a crimp to secure the shell to the ferrule, the invention is not limited thereto.

While the invention has been described in the preferred embodiment as being a sleeve made of a transparent polyvinyl chloride material, the invention is not limited thereto. Among other materials, the invention could be made of a heat shrink material such that after being positioned on the contact and crimped therein, the material could be heated to shrink around the exposed braid and draw tightly against the cable jacket.

I claim:

1. A method of assembling a coaxial contact during termination of the coaxial contact to a coaxial cable having a center conductor surrounded by dielectric thence a braid and jacket, the method comprising the steps of:

securing the center conductor of the coaxial cable to a center coaxial contact;

passing a sleeve over the center contact;

passing the center contact through a ferrule;

positioning the center contact in a dielectric insert member;

positioning the braid over the ferrule with the sleeve;

positioning the center contact and insert within an outer shell; and crimping the outer shell around the sleeve.

2. A coaxial contact terminated to a coaxial cable having a center conductor, a dielectric spacer surrounding the center conductor, and a braid with an exposed portion surrounding the dielectric spacer, comprising:

an electrically conductive shell having a crimpable portion;

a center contact terminated to the center conductor, said center contact disposed concentrically in the shell and isolated therefrom;

an electrically conductive ferrule having a cylindrical section received over the dielectric spacer;

a sleeve slidable along the cable to lay the braid, said sleeve positioned over the exposed portion of braid, with the exposed portion of braid positioned over the cylindrical section of the ferrule, the crimpable portion of the shell positioned proximate the sleeve, with the crimpable portion of the shell crimped about the sleeve.

3. In terminating a coaxial contact to a coaxial cable having a center conductor surrounded by dielectric thence a braid and jacket, a method of laying the braid comprising the steps of:

passing a sleeve over the cable and at least a limited length of the braid;

folding a limited length of the braid over the insulative sleeve;

passing a ferrule over the end of the cable; and sliding the sleeve toward the end of the cable to lay the braid over at least a portion of the ferrule.

4. A method of laying the braid in a coaxial contact as recited in claim 3, wherein passing an insulative sleeve over the cable comprises passing the insulative sleeve over an end of the cable.

5. A method of laying the braid in a coaxial contact as recited in claim 3, further comprising the steps of securing the center conductor of the coaxial cable to a center coaxial contact, and positioning the center contact in a dielectric insert member.

6. A method of laying the braid in a coaxial contact as recited in claim 5, further comprising the steps of positioning the center contact and insert within an outer shell, and crimping the outer shell around the sleeve.

7. In terminating a coaxial contact to a coaxial cable having a center conductor surrounded by dielectric thence a braid and jacket, a method of laying the braid comprising the steps of:

passing a sleeve over the cable and at least a limited length of the braid;

passing a ferrule over the end of the cable;

securing the center conductor of the coaxial cable to a center coaxial contact;

positioning the center contact in a dielectric insert member;

positioning the center contact and insert member within an outer shell;

sliding the sleeve toward the end of the cable to lay the braid over at least a portion of the ferrule; and crimping the outer shell around the sleeve.

8. A kit of parts for a coaxial contact for termination to a coaxial cable having a center conductor surrounded by a dielectric thence a braid having an exposed portion, and a jacket, the coaxial contact comprising:

a sleeve adapted to be positioned over the cable at a location such that the exposed portion of the braid is folded over an end thereof;

a ferrule having a forward portion and a rearward portion, the ferrule receivable over an end of the cable;

a center contact adapted to be terminated to the center conductor of the coaxial cable; and a dielectric spacer adapted to receive and secure the center contact therein, the dielectric spacer adapted to be received in the forward portion of the ferrule such as by the ferrule being slidable toward the end of the cable to receive a portion of the dielectric spacer within the forward portion of the ferrule, the sleeve adapted to be slid along the cable toward an end thereof to lay a substantial portion of the exposed portion of the braid over the rearward portion of the ferrule with the substantial portion of the exposed portion of the braid positioned over a rear portion of the ferrule substantially as it was originally in the cable, albeit perhaps radially enlarged due to being received over the rear portion of the ferrule whereby the braid is subsequently crimped to engage the rearward portion of the ferrule.

9. A coaxial contact as recited in claim 8, wherein the sleeve is transparent, whereby the braid can be inspected.

10. A kit of parts for a coaxial contact as recited in claim 8, further comprising an electrically conductive shell having a crimpable portion, the crimpable portion adapted to be received over the sleeve and ferrule, the crimpable portion of the shell adapted to be crimped over the sleeve to assure engagement between the braid and the rearward portion of the ferrule.

11. A coaxial contact as recited in claim 8, wherein the sleeve is nonconductive.

12. A coaxial contact as recited in claim 11, wherein the sleeve extends to overlap the cable jacket.

13. A coaxial contact as recited in claim 8, wherein the sleeve is cylindrical in shape.

14. A coaxial contact as recited in claim 13, wherein an inside diameter of the sleeve is greater than an outside diameter of the cable jacket.

* * * * *